United States Patent [19]

Rosheim

[11] Patent Number: 4,691,973

[45] Date of Patent: Sep. 8, 1987

[54] SUPERCONDUCTING CONNECTOR

[75] Inventor: Mark E. Rosheim, St. Paul, Minn.

[73] Assignee: Sperry Corporation, Blue Bell, Pa.

[21] Appl. No.: 871,213

[22] Filed: Jun. 5, 1986

[51] Int. Cl.[4] ..... H01R 13/20

[52] U.S. Cl. ..... 439/161; 439/273; 439/932

[58] Field of Search ..... 339/30, DIG. 1, 94 R; 174/126 S

[56] References Cited

U.S. PATENT DOCUMENTS

| | | | |
|---|---|---|---|
| 1,635,830 | 7/1927 | Gagnon | 339/30 |
| 3,079,580 | 2/1963 | Paasche | 339/94 R |
| 3,111,352 | 11/1963 | Theodoseau | 339/30 |
| 3,472,944 | 10/1969 | Morton et al. | 174/126 S X |
| 4,187,387 | 2/1980 | Parmer | 174/126 S X |
| 4,462,651 | 7/1984 | McGaffigan | 339/30 |

FOREIGN PATENT DOCUMENTS

| | | | |
|---|---|---|---|
| 3150294 | 7/1983 | Fed. Rep. of Germany | 339/30 |

*Primary Examiner*—Gil Weidenfeld
*Assistant Examiner*—Steven C. Bishop
*Attorney, Agent, or Firm*—Glenn W. Bowen; Laurence J. Marhoefer

[57] ABSTRACT

A superconducting pin and socket conductor is formed with a cylindrical pin of superconducting material, such as niobium, which fits into a mating superconducting cylinder, such as niobium or titanium, which is open at the top. A superconducting wire is laser welded to the bottom of the cylinder and a second niobium wire is laser welded to the top of the pin. A sleeve of a material, such as copper, aluminum, or magnesium, which at liquid helium temperatures has a much higher coefficient thermal expansion than the superconducting material, surrounds the cylinder. As a result, upon cooling the outer sleeve crimps the cylinder into a firm and uniform contact along the length of the pin.

6 Claims, 1 Drawing Figure

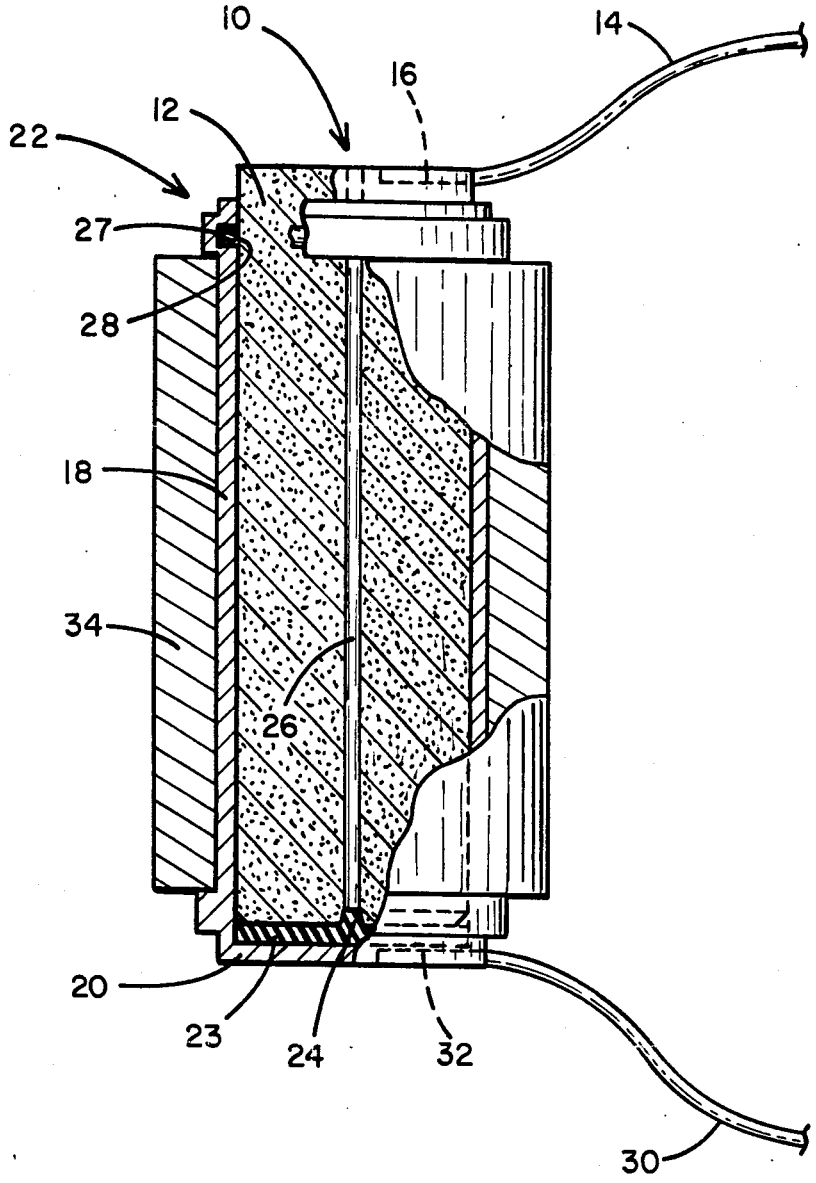
10
14
16
12
22
27
28
18
34
26
20
23
24
32
30

SUPERCONDUCTING CONNECTOR

BACKGROUND OF THE INVENTION

At the present time very few electrical connecting devices are available for making reliable connections to superconductor elements. A simple screw binding approach is commonly used which often fails to make good electrical contact and is subject to working loose relatively easily. There are also permanent or semi-permanent connections but there cannot easily be disconnected, or reconnected, when alteration, or repair, of the connector becomes necessary. In addition superconductor connectors are often subject to the entry of oxygen, which in its liquid or solid form can oxidize the superconducting niobium or titanium and degrade the contact.

SUMMARY OF THE INVENTION

The present invention provides a robust, reliable pin and socket electrical connection for superconductor elements which greatly facilitates the ability to connect and disconnect superconductive components from one another. A sleeve is provided around a superconducting cylindrically shaped female connecting element that receives a cylindrical pin therin, which is made of a material that crimps the female element into firm contact with the male connector element upon cooling to a superconducting temperature, but which allows disassembly at a higher temperature.

BRIEF DESCRIPTION OF THE DRAWING

The FIGURE represents a cross-sectional view of a superconductor connector constructed in accordance with the present invention.

TECHNICAL DESCRIPTION OF THE INVENTION

A superconductor connector 10 constructed in accordance with the present invention is shown in the FIGURE in which a male cylindrical shaped pin 12, which is constructed, for example, of superconducting niobium, is electrically connected to a superconducting wire 14 of niobium or titanium by laser welding, or other suitable means, at a junction area 16. The pin 12 mates with a female connector cylinder 18 which is closed at its bottom 20, and open at its top 22 so as to be capable of receiving the pin therein. A sealing gasket 23 is placed on the interior of the cylinder 18 and rests on the bottom 20. The gasket 23 may be made of silicon or other suitable elastomer materials, for example, those sold under the trademarks Viton, Teflon and Silastene may be employed. The gasket 23 has truncated conical section 24 which seals off the bottom of a vent channel 26 in the male pin 12. The vent channel 26 runs through the center of the male pin 12 to allow for the passage of gas and liquid therethrough. In particular oxygen which may oxidize niobium and degrade the niobium-to-niobium contact is allowed to escape through the channel 26 when the male pin 12 is placed into the cylinder 18.

A sealing O ring 27 is also placed in a sealing recess 28 at the upper end of the cylindrical connector 18 to seal off the upper section of the connector where the pin 12 merges from the cylinder 18. Electrical connection to the cylinder 18 is made through a second superconducting wire 30, which is preferably laser welded to the bottom 20 of the cylinder 18 at the area 32.

A cylindrical sleeve 34 which is open at both ends is placed over the outside of the cylinder 18. The sleeve 34 is made of metal which has a higher thermal coefficient of expansion than niobium or titanium or alloys thereof, at liquid helium temperatures. Therefore, as the connector assembly is cooled toward a temperature of absolute zero, the outer sleeve 34 restricts the outer dimensions of cylinder 18 more and more so that the pin 12, which is free to slide in the cylinder 18, at higher temperatures, is locked into place by constriction of the cylinder 18 along substantially its entire length to form a semi-permanent connection as long as the device is maintained at superconducting temperatures. As the temperature rises, the outer sleeve which may be formed of aluminum, copper, magnesium, or alloys thereof, or other suitable material, expands at a greater rate than the superconducting cylinder and pin elements and, this allows the pin 12 to be removed from the cylinder 18 at an elevated temperature above the superconductive operating temperature intended for the connector.

While a particular embodiment of the present invention has been shown and described, it is intended that variations of the described invention which constitute obvious modification to those skilled in the art be included within the scope of dependent claims.

What is claimed is:

1. A superconducting connector comprising a cylindrical male pin consisting of a superconducting material, a cylindrical mating female member consisting of superconducting material for receiving the male pin therein in sliding contact therewith, a cylindrical sleeve surrounding the outside of said cylindrical female member which consists of a material which has a higher thermal coefficient of expansion than said superconducting material wherein when said connecting assembly is cooled to superconducting temperature range said sleeve constricts said cylindrical female member so that said female member secures said male pin therein at a superconducting operating temperature range and when the temperature is elevated above said superconducting operating temperature range said male pin may be removed from said female member, first electrical conductor means connected to said male pin and second electrical conductor means connected to said female member, wherein said male pin is cylindrical and has a centrally located venting channel which extends throughout its entire length.

2. A superconducting connector comprising a cylindrical male pin consisting of a superconducting material, a cylindrical mating female member consisting of superconducting material for receiving the male pin therein in sliding contact therewith, a cylindrical sleeve surrounding the outside of said cylindrical female member which consists of a material which has a higher thermal coefficient of expansion than said superconducting material wherein when said connecting assembly is cooled to superconducting temperature range said sleeve constricts said cylindrical female member so that said female member secures said male pin therein at a superconducting operating temperature range and when the temperature is elevated above said superconducting operating temperature range said male pin may be removed from said female member, first electrical conductor means connected to said male pin and second electrical conductor means connected to said female member wherein said female member is closed at its bottom and open at its top and a gasket is located intermediate said closed bottom of said female member and a portion of said male pin which is adjacent said bottom and an O ring seals off the area between a portion of said male pin adjacent the open end of said female member and said female member.

3. A superconducting connector as claimed in claim 1 wherein said outer sleeve is constructed from the class of materials consisting essentially of copper, aluminum and magnesium, or alloys thereof, and said male pin and said female member are constructed from the class of materials consisting essentially of niobium and titanium, or alloys thereof.

4. A superconducting connector as claimed in claim 1 wherein said female member is closed at its bottom and open at its top and a gasket is located intermediate said closed bottom of said female member and a portion of said male pin which is adjacent said bottom and an O ring seals off the area between a portion of said male pin adjacent the open end of said female member and said female member.

5. A superconducting connector as claimed in claim 4 wherein said outer sleeve is constructed from the class of materials consisting essentially of copper, aluminum and magnesium, or alloys thereof, and said male pin and said female member are constructed from the class of materials consisting essentially of niobium and titanium, or alloys thereof.

6. A superconducting connector as claimed in claim 2 wherein said outer sleeve is constructed from the class of materials consisting essentially of copper, aluminum and magnesium, or alloys thereof, and said male pin and said female member are constructed from the class of materials consisting essentially of niobium and titanium, or alloys thereof.

* * * * *

UNITED STATES PATENT AND TRADEMARK OFFICE

CERTIFICATE OF CORRECTION

PATENT NO. : 4,691,973

DATED : September 8, 1987

INVENTOR(S) : Mark E. Rosheim

It is certified that error appears in the above-identified patent and that said Letters Patent are hereby corrected as shown below:

IN THE PRINTED PATENT

Column 1, line 12, "there" should be -- these -- .

Column 1, line 27, "therin" should be -- therein -- .

Signed and Sealed this

Twelfth Day of January, 1988

*Attest:*

DONALD J. QUIGG

*Attesting Officer*

*Commissioner of Patents and Trademarks*